US008588428B2

(12) United States Patent
Croft, III

(10) Patent No.: US 8,588,428 B2
(45) **Date of Patent: *Nov. 19, 2013**

(54) DYNAMIC POWER SHARING IN A MULTI-CHANNEL SOUND SYSTEM

(75) Inventor: James J. Croft, III, San Diego, CA (US)

(73) Assignee: LRAD Corporation, San Diego, CA (US)

( * ) Notice: Subject to any disclaimer, the term of this patent is extended or adjusted under 35 U.S.C. 154(b) by 1373 days.

This patent is subject to a terminal disclaimer.

(21) Appl. No.: 12/197,799

(22) Filed: Aug. 25, 2008

(65) Prior Publication Data

US 2009/0268917 A1 Oct. 29, 2009

Related U.S. Application Data

(63) Continuation of application No. 11/986,568, filed on Nov. 20, 2007, now abandoned, which is a continuation of application No. 10/332,660, filed as application No. PCT/US01/21755 on Jul. 11, 2001, now Pat. No. 7,298,852.

(60) Provisional application No. 60/217,266, filed on Jul. 11, 2000.

(51) Int. Cl.
*H04R 29/00* (2006.01)

(52) U.S. Cl.
USPC ..... 381/56; 381/55; 381/119; 381/120

(58) Field of Classification Search
USPC ..... 381/102–10, 119, 102–109, 307, 381/119.55, 17, 55–56, 120; 330/207 P
See application file for complete search history.

(56) References Cited

U.S. PATENT DOCUMENTS 4,048,573 A 9/1977 Evans et al.
4,327,250 A 4/1982 Von Recklinghausen (Continued)

FOREIGN PATENT DOCUMENTS

JP 61-84909 4/1986
JP 2 026500 1/1990

(Continued)

OTHER PUBLICATIONS

U.S. Appl. No. 11/986,568; filed Nov. 20, 2007; James J. Croft III; office action issued Jun. 13, 2011.

(Continued)

*Primary Examiner* — Disler Paul
(74) *Attorney, Agent, or Firm* — Thorpe North & Western LLP

(57) ABSTRACT

A signal processing system for use in a multi-channel audio system having a plurality of power amplifier channels connected to a plurality of loudspeakers and power amplifiers, configured to receive and reproduce audio signals through the loudspeakers, and at least a first channel of the plurality of power amplifier channels amplifying a first audio signal, comprises a processor responsive to a signal level threshold applicable to at least said first channel, such that at and above the signal level threshold, the first audio signal in the first channel is amplitude limited and a portion of at least the first audio signal is mixed into at least a second channel. The amplitude limiting and signal mixing is configured so as to reduce introduction of at least one of: a) audible tonal distortion; and b) perceivable spatial distortion; of a sonic presentation due to said limiting and signal mixing.

33 Claims, 8 Drawing Sheets

(56) References Cited

U.S. PATENT DOCUMENTS

| | | | | |
|---|---|---|---|---|
| 4,525,855 | A | 6/1985 | Willcocks | |
| 5,148,491 | A | 9/1992 | Sakamoto et al. | |
| 5,245,229 | A | 9/1993 | Colvin, Sr. | |
| 5,307,415 | A | 4/1994 | Fosgate | |
| 5,469,510 | A * | 11/1995 | Blind et al. | 381/55 |
| 5,583,962 | A | 12/1996 | Davis et al. | |
| 5,652,800 | A | 7/1997 | Roberts | |
| 5,774,567 | A | 6/1998 | Heyl | |
| 5,873,065 | A | 2/1999 | Akagiri et al. | |
| 6,501,717 | B1 | 12/2002 | Yamazaki | |
| 6,704,421 | B1 | 3/2004 | Kitamura | |
| 7,298,852 | B2 * | 11/2007 | Croft, III | 381/56 |
| 2005/0129256 | A1 * | 6/2005 | Metcalf | 381/119 |

FOREIGN PATENT DOCUMENTS

| | | |
|---|---|---|
| JP | 06121398 | 4/1994 |
| JP | 1032896 | 2/1998 |
| JP | 2000 059896 | 2/2000 |
| WO | WO 00/04744 | 1/2000 |
| WO | WO 02/05261 | 1/2002 |

OTHER PUBLICATIONS

Croft, James et al., U.S. Appl. No. 11/986,568, filed Nov. 20, 2007.

* cited by examiner

DYNAMIC POWER SHARING IN A MULTI-CHANNEL SOUND SYSTEM

CROSS-REFERENCE TO RELATED APPLICATIONS AND CLAIM OF PRIORITY

This is a continuation of U.S. patent application Ser. No. 11/986,568, filed Nov. 20, 2007, which is a continuation of U.S. application Ser. No. 10/332,660 filed on Jan. 10, 2003, which is the National Stage of International Application No. PCT/US01/21755 filed on Jul. 11, 2001, which claims priority to U.S. provisional application Ser. No. 60/217,266 filed on Jul. 11, 2000, each of which are herein incorporated by reference in their entirety.

TECHNICAL FIELD

The present invention relates generally to multiple channel sound systems. More particularly, the present invention relates to power distribution in multiple channel sound systems.

BACKGROUND ART

In today's home entertainment industry, high fidelity, spatially accurate sound is very important and surround sound systems are a predominant delivery system for sound reproduction. Surround sound systems typically have 5 or more channels and at least one woofer or sub-woofer channel. A surround sound system generally uses the front center channel(s) for human voice and the dominant sounds in the program source or for sounds which are meant have a sonic image centered with picture. The additional channels are used for special effects or other sounds, which have non-center front image placement or spatial movement. Channels behind the viewer or listener are used to simulate sound approaching from behind the viewer or to provide ambient, spatial, or enveloping sounds. This type of speaker arrangement can allow the viewer or listener to hear a virtual jet or space vehicle fly from their left side to their right side or even from behind.

Surround sound systems also use volume cues to provide the illusion of movement. In the example of a recording of a jet, when the jet is far away the listener will hear a quieter sound. Then as the jet approaches, a speaker's output can increase until it reaches its maximum volume and then the sound decreases as the jet passes away. Directional cues are most often dominated by the speaker(s) having the loudest output. Most program sources tend to have greater signal levels sent to a particular channel at a given point in time to achieve audible direction or movement to the sound. One disadvantage with such a system is that any one or more of the channels can be driven into overload by high intensity signals building in one channel or high-level directional signals as they move from channel to channel. When the signal passes the maximum signal level threshold of the speaker or amplifier then the sound can become distorted and limited in level. Conventional systems do not provide a solution to this problem, with the exception of increasing the size and power capability of the system to be able to have greater output without overload. This can be very costly and also may require systems of larger than practical size for placement into a domestic environment.

SUMMARY

Figure 1:
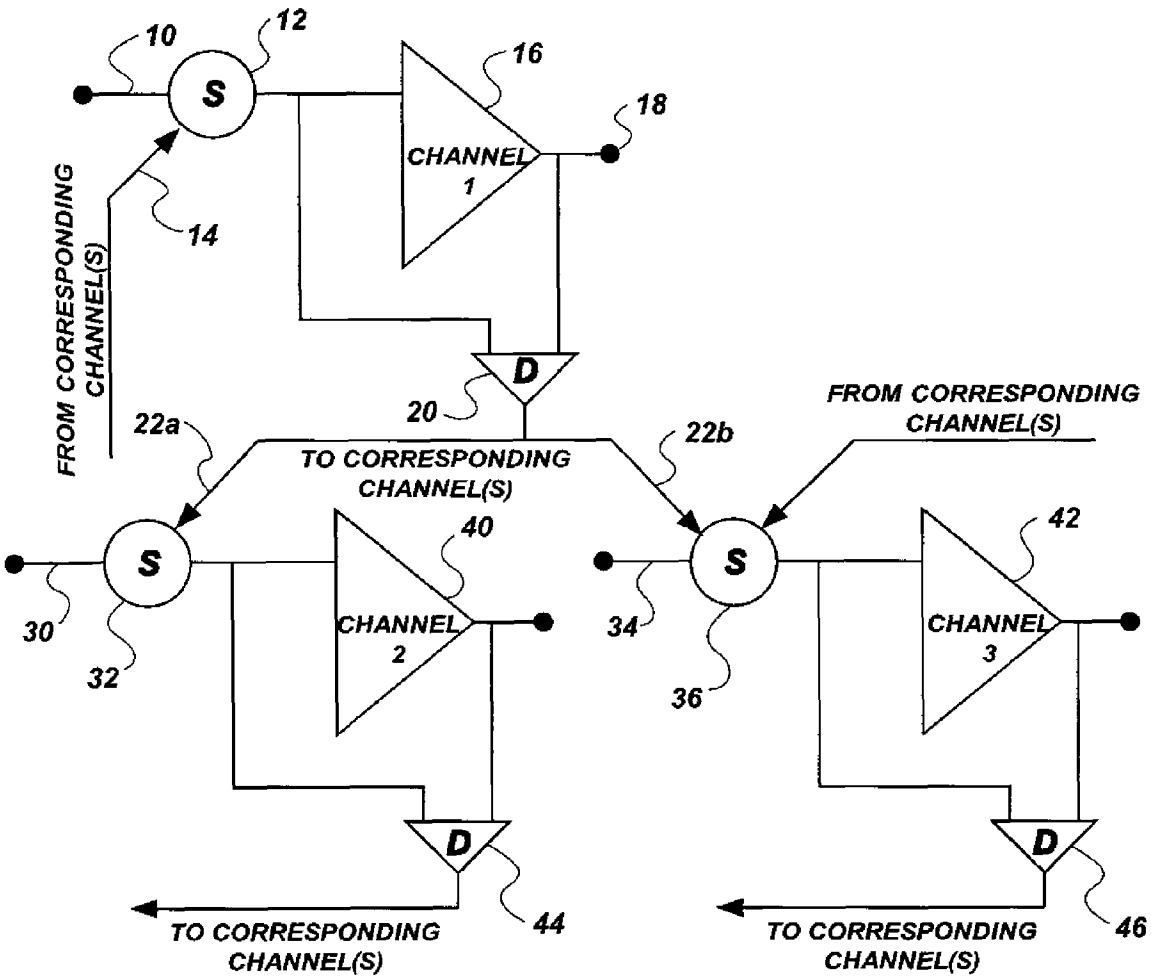
FIG. 1 is a schematic diagram of a preferred embodiment of a circuit for dynamic power sharing in a multi-channel sound system in accordance with the present invention.

A signal processing system for use in a multi-channel audio system having a plurality of power amplifier channels connected to a plurality of loudspeakers and power amplifiers, configured to receive and reproduce audio signals through the loudspeakers, and at least a first channel of the plurality of power amplifier channels amplifying a first audio signal, comprises a processor responsive to a signal level threshold applicable to at least said first channel, such that at and above the signal level threshold, the first audio signal in the first channel is amplitude limited and a portion of at least the first audio signal is mixed into at least a second channel. The amplitude limiting and signal mixing is configured so as to reduce introduction of at least one of: a) audible tonal distortion; and b) perceivable spatial distortion; of a sonic presentation due to said limiting and signal mixing.

Additional features and advantages of the invention will be apparent from the detailed description which follows, taken in conjunction with the accompanying drawings, which together illustrate, by way of example, features of the invention.

DETAILED DESCRIPTION

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

FIG. 1 illustrates a schematic of one embodiment of a circuit for dynamic power sharing in a multi-channel sound system in accordance with the present invention. A multi-channel sound system includes 3 or more channels, such that for any one channel there are two corresponding channels with directional vectors and sound output on each side of the one channel.

In FIG. 1, a channel signal 10 enters a summing amplifier 12. If an overload signal is present then that will be received on a corresponding channel input 14. The original channel signal will be summed with any overload signals and sent to channel 1's amplifier 16. The original signal or the combination signal can at some point overload the channel. Upon a specified signal threshold, such as amplifier overload of the first channel, the first channel is limited in output and any increases in signal for that channel are routed to the two corresponding channels on each side of the first channel. This is in contrast to conventional systems where the amplifier upon entering into overload can clip or distort the signal before it is delivered to the load 18 or audio transducer.

A differential amplifier 20 is used in the present system to receive a first input from Channel 1's output and a second input from the summing amplifier. The output of the differential amplifier is the difference between the signal entering the amplifier and the signal leaving the amplifier or the signal amount by which the channel is overloaded. The differential amplifier preferably uses a unity gain but gain can also be used. Gain would only be incorporated into the differential amplifier when an amplified signal was required to be delivered to the corresponding channels. For example, gain might be used if the corresponding overflow channels are more distant from the listener than the original speakers.

The signal from the differential amplifier 20 is routed to at least one other corresponding channel. FIG. 1 illustrates that the difference signal is provided to channel 2 and channel 3 (40 and 42). The summing amplifiers 32, 36 of channels 2 and 3 combine their channel input 30, 34 with the output from the differential amplifier 22*a*, 22*b*. The summed output is then delivered to channels 2 and 3 (32 and 36). This way the system is not limited by the overload of any given channel while maintaining substantially the same directionality of sound. Channels 2 and 3 can also transfer their overload to other channels through their own differential amplifiers 44, 46. This circuit is depicted as an analog circuit but it can also be implemented as a digital signal processor (DSP) or in software which has the same digital functionality.

Each channel has a threshold limit and when the signal passes that threshold then the signal above or near that threshold is passed over to other channels. The threshold limit may be based on, but not limited to, amplifier clipping, excursion limits of the transducer, frequency dependent limiting, thermal limits, etc.

The source channel can be made to include a phase lead compared to the corresponding supplementary channels so as to further support directionality cues psycho-acoustically. When a listener hears the source channel earlier than the supplementary channels, there is further psychoacoustic reinforcement for the user to hear the source channel as the directional source of the sound. The supplementary channels can affect the volume but the user mentally filters out the directionality from those channels because they are heard a very short time later. Delay circuitry can be incorporated between the channels or included as part of the differential amplifier to provide the required phase lead.

If the second or third channels that receive the rerouted signal also reach their signal threshold, that overload can be divided and routed to one or more additional channels. When the present invention is applied to a five-channel system and channel 1 is overloaded, a portion of the signal at or above overload can be rerouted to channels 2 and 3. It may be of further advantage to limit, compress or reduce the gain of the channel reaching an overload threshold and do it in such a way as to limit audible distortion from that channel. If channel 2 or 3 also becomes overloaded, a portion of that signal can be rerouted to channel 4 and/or 5. Although there is some directionality that may be lost through multiple rerouting, this is compensated for by the fact that the re-routing only happens when the sound is very loud and some amount of directionality loss may be less important. Generally, tonal distortion tends to be sonically more noticeable or objectionable to the ear than distortions in directionality. Therefore, it tends to be much more important to eliminate tonal distortions, even if potentially at the cost of some directionality distortion. Accordingly, one embodiment of the invention can substantially eliminate tonal distortions, due to channel overload, while at the same time preserve the accurately perceived directionality cues.

A further threshold detector can be included so if channel 1 starts to limit, then more of channel 1's signal is shared with channel two than channel three at the limiting point. This way as the signal is portioned off to the other two channels, more of the signal is sent to channel two than channel three. In some cases this can maintain a more accurate spatial image position, such as if channel one is a right front channel, channel two is a center channel and channel three is a right surround channel. This asymmetrical mixing can also be beneficial if channel two is a more robust channel than channel three and therefore can accommodate more signal before it reaches overload. The source channel may also want to have a phase lead relative to the supporting channels or alternatively, the other two supporting channels may include a time delay relative to the primary source channel or other known psychoacoustic characteristics may be applied to maintain directionality cues in the significant channel(s). A ratio splitter can be included with the differential amplifier circuitry. This way a larger ratio of the signal can be sent to a front speaker and a smaller ratio to the back speaker or vice-versa.

Using a dynamic power sharing configuration also can reduce the cost of the speaker system. Instead of requiring each speaker or amplifier channel to have a large enough capacity to carry the maximum output, each channel or speaker may be reduced to carry a smaller capacity. When the signal exceeds the signal threshold for the smaller speakers, the additional signal is rerouted to the other associated channels. This approach can provide the same amount of apparent sound output as a larger system, while using a smaller overall system, including either lower output speakers and/or reduced amplifier power.

Figure 2:
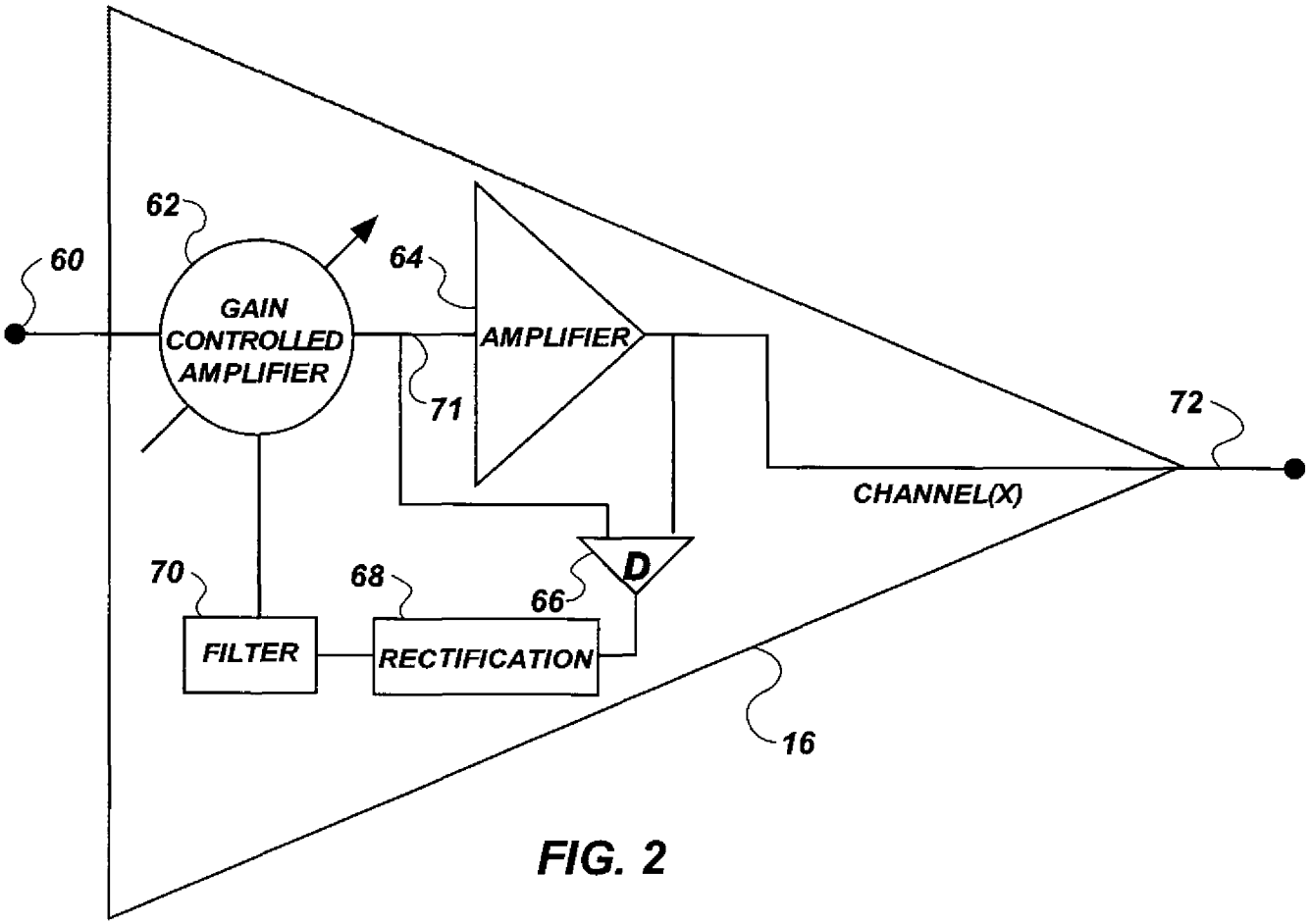
FIG. 2 is a schematic diagram of channels 1-3 in FIG. 1.

FIG. 2 is a schematic of components contained in the channels 1-3 in FIG. 1. The audio signal 60 enters the channel 16 and passes through the gain controlled amplifier 62. The output amplifier 64 then amplifies the signal. A differential amplifier 66 compares the difference between the input signal 71 and the output signal 72 for the output amplifier. When the output amplifier begins to clip or to overload then the output signal will be less than the input signal. The differential amplifier then sends a difference signal to the gain controlled amplifier based on the difference between the input and output of the output amplifier. The gain controlled amplifier has a variable component (such as a variable resistor) which is tuned to hold the signal to a certain level, according to the input from the difference amplifier, and to keep the signal from clipping further. For example, when the output amplifier begins to produce 1% distortion then the gain controlled amplifier can reduce the amplifier gain. This limits the clipping in the output amplifier. A rectification circuit 68 is used to produce an absolute value for the differential signal delivered by the differential amplifier. This way both the positive and negative portions of the signal will have positive gain control to reduce distortion and/or clipping. A filter 70 is used before the differential signal reaches the gain controlled amplifier to remove noise from the feedback circuit.

Figure 2A:
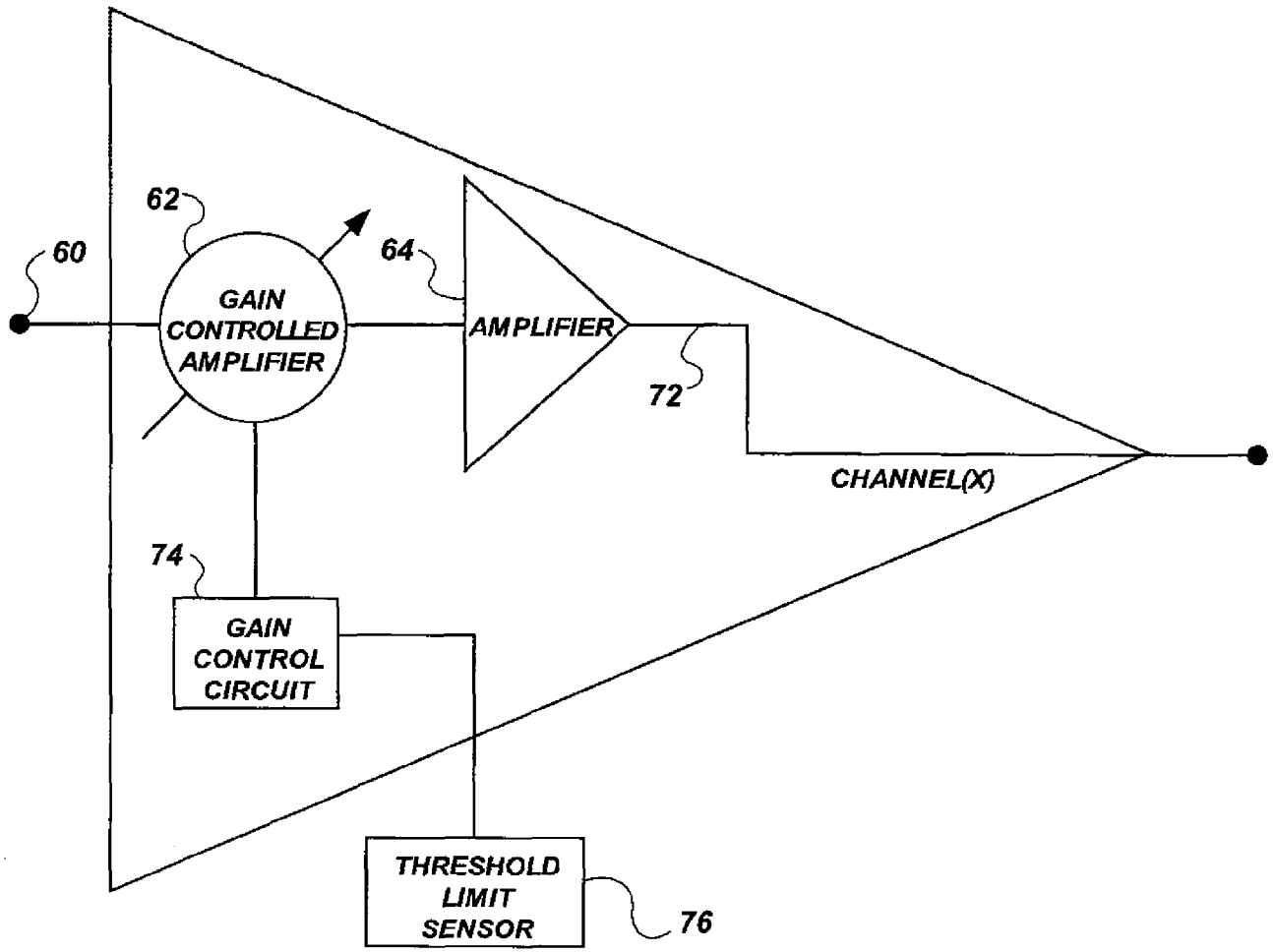
FIG. 2*a* is a schematic diagram of a channel circuit that can sense other threshold parameters besides amplifier power clipping.

The threshold limit at which the first channel begins to transfer power to other channels can be based on signal frequency, thermal characteristics, excursion limits of the transducer, amplifier clipping, physical transducer characteristics, thermal transducer characteristics, thermal effects on amplifier, signal effects on amplifier, power effects on amplifier, and other similar phenomenon which can affect the signal or the components of the system. FIG. 2*a* illustrates a circuit that can sense other threshold parameters besides amplifier clipping. The gain controlled amplifier 62 receives the input signal and passes that to the output amplifier 64 which then delivers an output signal 72 to the load. The gain controlled amplifier is not controlled by an amplifier feedback in this case, but it is controlled by a gain control circuit 74. The signal or voltage produced by the gain control circuit is determined by the threshold limit sensor 76. The threshold limit sensor can be a physical environment sensor, stress gauge sensor, heat sensor, signal sensor, or a voltage sensor.

For example, if the excursion limits of the transducer are defined as the maximum threshold limit, then a sensor can be used at the transducer (e.g., speaker cone) to determine when the transducer approaches the maximum physical displacement before it is damaged. The maximum displacement can also be measured based on the maximum safe voltage threshold for the transducer. When the voltage approaches a maximum voltage that can damage the transducer then the gain control circuit reduces the gain in the gain controlled amplifier. The threshold limit sensor operates in the same fashion for a temperature sensor or a maximum frequency sensor. The signal can also be limited based on the temperature of the operating components.

Figure 3:
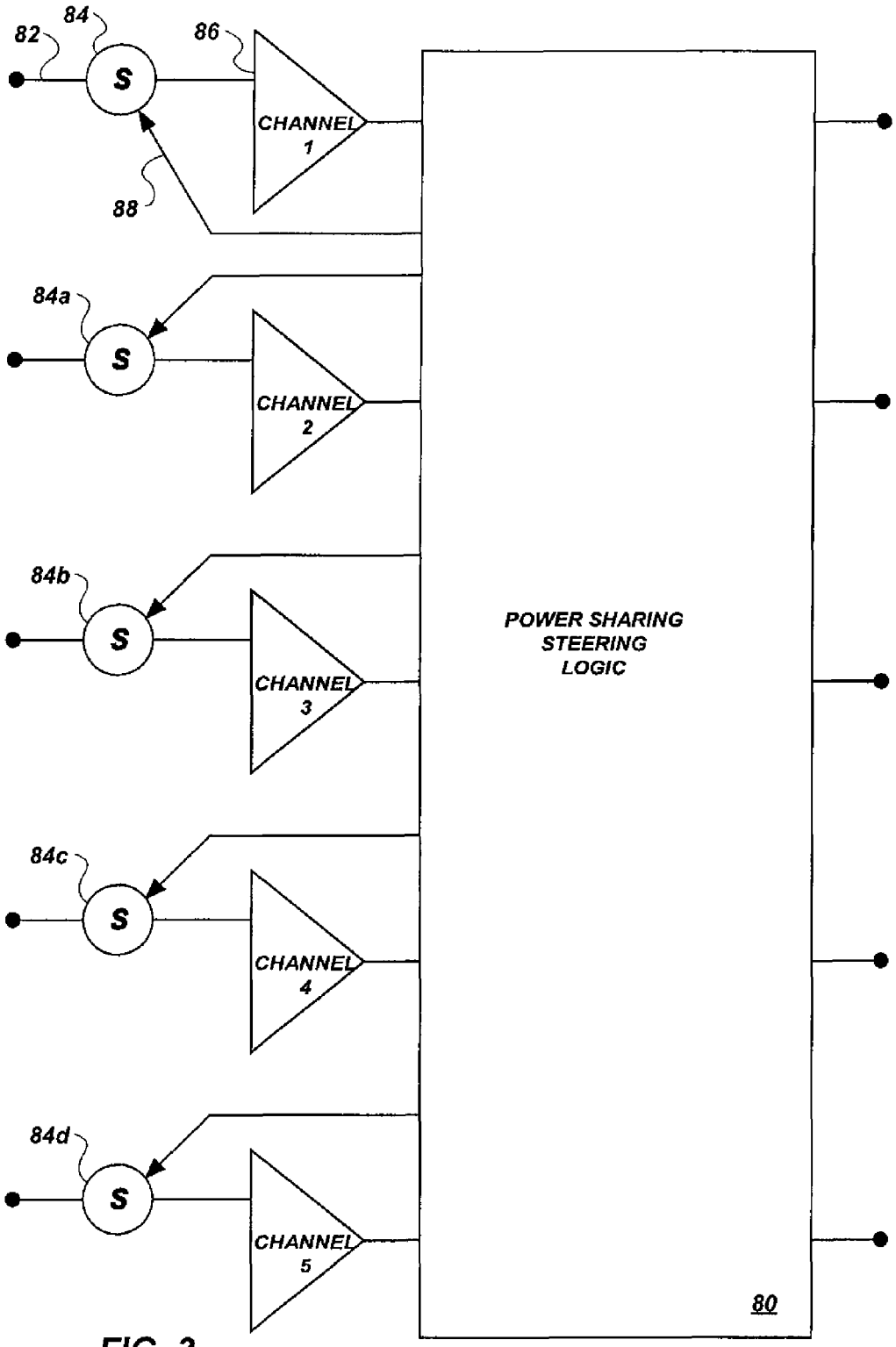
FIG. 3 is a schematic diagram of a multi-channel system with digital power sharing steering logic.

FIG. 3 is a schematic of a multi-channel system with power sharing steering logic. The analog circuits shown FIGS. 1 and 2 may be implemented in a digital signal processing chip (DSP) 80. A first input 82 can be summed together in a summing circuit 84 with overload signals 88 from other channels. The input signal is then passed onto Channel 1 (86) and into the power sharing steering logic. If Channel 1 begins to overload, then that overloaded signal can be diverted to Channel 2 or 3 through their summing circuits 84*a*, 84*b*. It is also possible that portions of the overloaded signal can be diverted to Channels 3 and 4 and incorporated through their summing circuits 84*c*, 84*d*.

The overload signal from one channel may be divided between the other channels in several ways. One method is picking two or more channels corresponding to a primary channel and then dividing the signal equally between them. Another method is dividing the signal between two or more channels based on the physical location of those channels. For example, a rear speaker can have less output delivered to it than a front speaker. It is also possible that a given channel will have any one, two, three or more of the channels as its corresponding channel. Channel 1 can route its signal to channel 5 or to channels 3, 4, and 5. The configuration of the overload is based on the number of channels available, the amount of overload that exists at a given point in time, and the audio image that the system should present. Of course, a preferred embodiment of this device reroutes the overloaded portion of the signal to two other channels.

Dynamic power sharing can be used with two speaker stereo systems. When the first channel reaches the overload signal threshold, then the signal power over that threshold is diverted to the second channel. Similarly, even a multiple channel system can divert the power over a certain threshold to only one channel instead of dividing it between two. While this would ameliorate tonal distortions due to overload, it may still be preferable to mix the signal level above the threshold to at least two additional channels, preferably ones that have speakers straddling the primary channel which can be placed physically between the two additional channels.

Alternatively, the power can be rerouted to three or more other channels based on the directionality that is desired. For example, several channels and transducers can be physically stacked on top of each other. As the first channel begins to overload, the signal can be rerouted to a second speaker that is physically above the first speaker. This maintains directionality and provides a stronger undistorted signal as needed. Since a speaker is only driven to its maximum level a small portion of the time, using two smaller speakers to replace one larger speaker can be space and cost effective.

Figure 4:
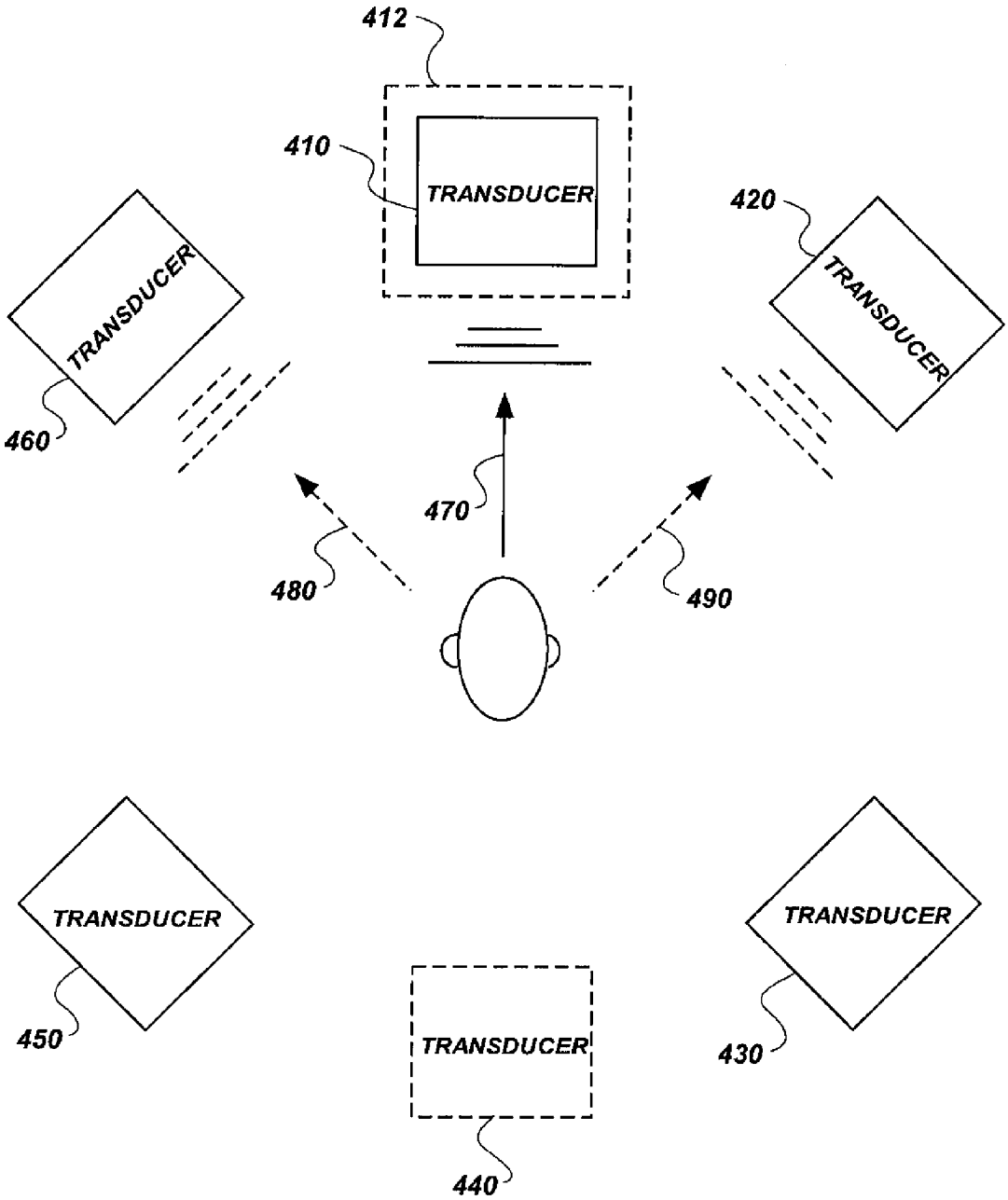
FIG. 4 illustrates power sharing with respect to a center channel.

FIG. 4 illustrates power sharing with respect to a center channel. When a signal that is delivered to the center channel 410, reaches a threshold value, overloads, or reaches a clipping point it can be symmetrically divided and transferred to the counterclockwise 460 and clockwise 420 front channels. In other words, the amount of signal above the threshold is routed to the left 460 and right 420 channels. The signal is divided symmetrically to avoid substantial audio image movement away from the center channel or transducer. This is possible because it is a common practice to locate the two front side channels symmetrically adjacent to the center channel. When the three channels reproduce the divided, overloaded signal, a virtual source 412 is produced that is larger than the output capability of the original center channel. Then if the right and left front channels overload, the signals from these channels can be rerouted to the right 430 and left 450 surround sound channels and their transducers. Some surround sound systems can optionally include a sixth rear speaker 440 and this sixth channel can be used to receive rerouted portions of an overloaded signal from the surround sound channels. Conversely, if the sixth channel overloads then the overload signal can be routed to the adjacent surround channels. If the surround channels overload from the sixth channel, then other channels can be selected to increase the overall sound output. Moreover, the system can send the overloaded portions of the signal to one or more subwoofers in the system. The solid arrow 470 in FIG. 4 represents the primary output direction of the speaker that has reached a threshold, and the dotted vectors 480, 490 represent directional output and cues provided by the auxiliary loudspeakers. The combined dotted vectors create a virtual direction vector that sum together in the direction of the solid line, so that the original direction vector does not audibly move.

Figure 5:
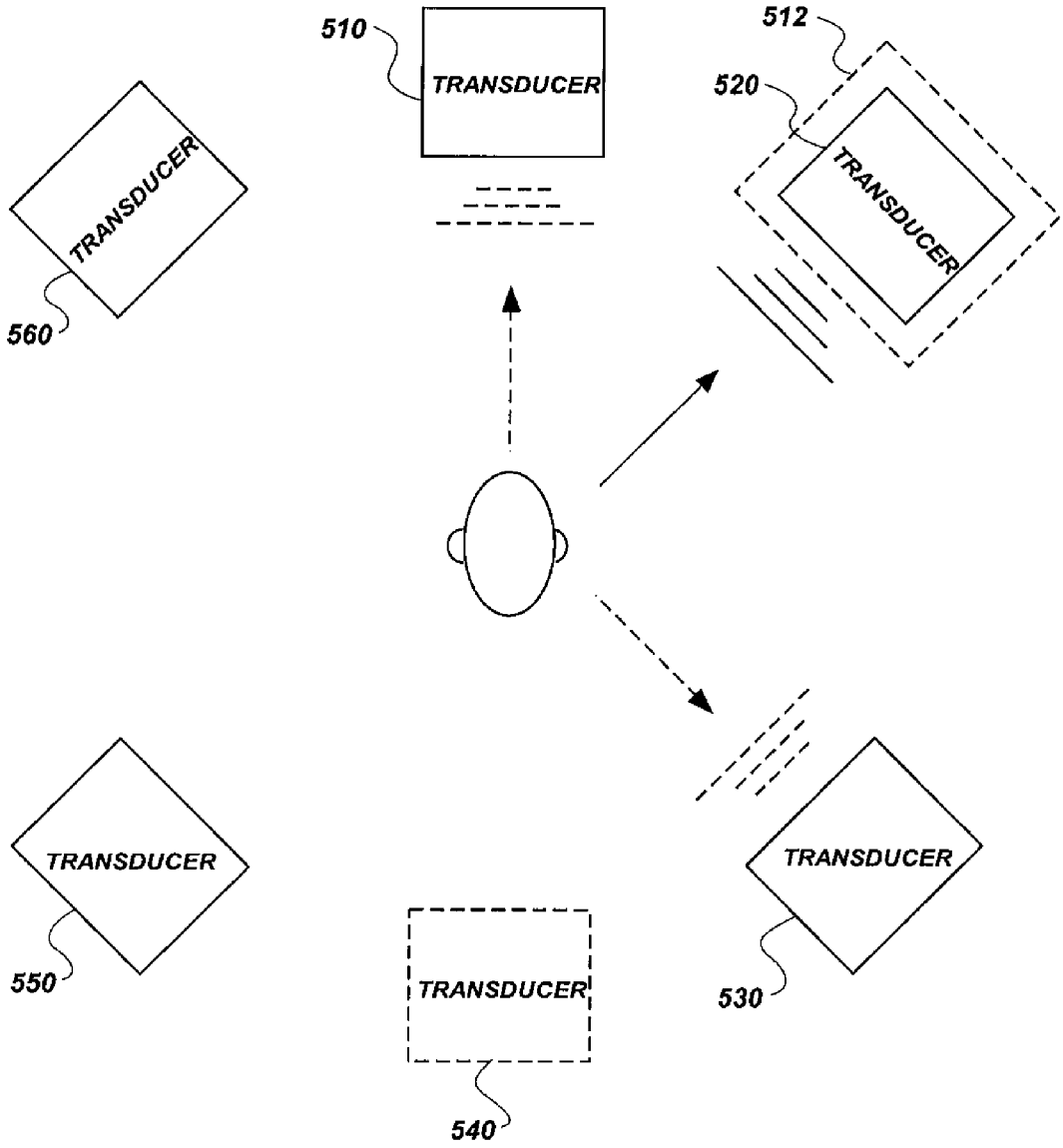
FIG. 5 illustrates power sharing with respect to a side channel.

FIG. 5 illustrates power sharing with respect to a side channel. An overloaded side channel may be treated differently in order to preserve the spatial orientation of the sound image. When the front right transducer overloads, the signal can be divided asymmetrically. The larger portion of the signal overload can be sent to the center channel 510 and the remaining portion of the overloaded signal can be sent to the right rear surround channel 530. Providing the larger portion of the signal to the front right channel helps reduce the sound image drift. If the overload signal is divided symmetrically, then this could cause the sound image to move behind the listener. This is because the surround transducers are usually weaker and placed farther away than the front speakers. As in the previous embodiments, when the speakers to the right and left of the speaker of interest overload, the signal can be rerouted to an adjacent speaker, which is not yet overloaded. For example, in FIG. 5 if the rear surround channel 530 overloads, the overload signal can be rerouted to one or more of the other channels 540, 550. Again, a virtual sound source is created 512, but it actually may be shifted more toward the rear surround speaker than the figure illustrates. Even if the image moves slightly in the present invention, this is much better than having a clipped signal, which provides audible distortion. Humans tend to have reduced levels of psychoacoustic perception for sounds that move with respect to the side of the head, as compared to sounds that move in front of the face.

The threshold limit at which the first channel begins to transfer power to other channels can be based on any of a variety of parameters such as signal frequency, component thermal characteristics, excursion or displacement of the loudspeaker diaphragm, amplifier clipping, and other similar phenomenon which can affect the original signal, cause damage to a system component, alter performance, or even cause local sound pressure levels to be greater than desired near a single channel. In addition, the triggering threshold could be some combination of any of the parameters or even an arbitrary value to create a desired sonic effect.

Figure 6:
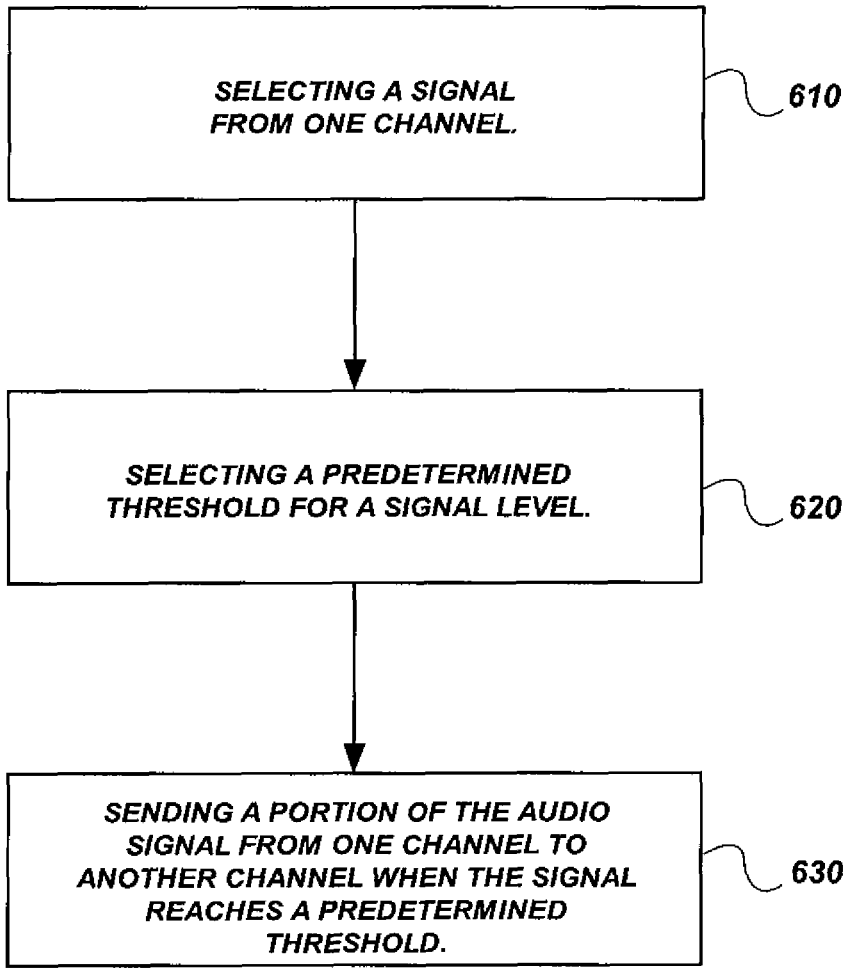
FIG. 6 illustrates a general method for power sharing.

Referring now to FIG. 6, a general method for increasing apparent acoustic output of a multi-channel sound system containing multiple channels, where each channel has an audio signal, will now be described. One step is selecting a signal from a channel of the multi-channel sound system 610. Another step is selecting a predetermined parameter threshold corresponding to signal level 620. A further step is sending a portion of the audio signal associated with at least one channel of the multi channel sound system to at least one other channel of the multi-channel sound system, when the signal reaches the predetermined parameter threshold.

Figure 7:
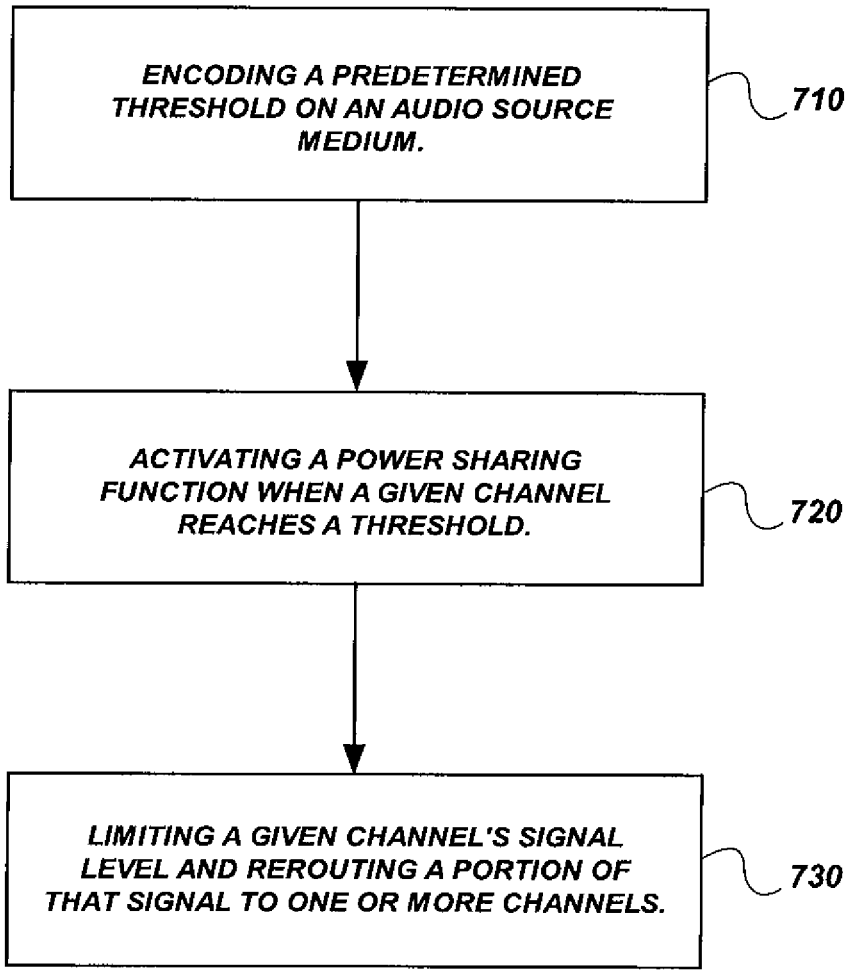
FIG. 7 illustrates a more specific method for power sharing.

FIG. 7 illustrates that it can be useful in some systems to apply the invention in such a way as to encode the audio program material to be performed with software or hardware control codes prior to or during recording on an audio source medium 710. When a given channel or channels reach a parameter threshold during playback, such as an amplitude threshold, a power sharing function can be activated 720. The power sharing can perform the step of limiting a given channel's signal level and rerouting a portion of that signal to one or more other channels 730. This approach can be generalized to operate with any system to minimize the demands on any particular channel or channels of that system.

In particular, the encoded software approach can be optimized for a particular audio system or can have adaptive settings for re-adapting the threshold parameter(s) for a variety of different systems, each with different characteristics. For example, the use of encoded software or hardware to preprogram power sharing could be implemented by a variety of specific applications, including (i) setting thresholds or implementing preprogrammed thresholds during recording or re-recording of the audio material for listening; (ii) applying arbitrary preset levels as estimated thresholds, based on the specific type of audio system to be used for playback; and (iii) incorporating a simple diagnostic program as part of the hardware or software preprogramming of the recorded material, thereby enabling automatic assessment of the audio system to be used, with derivation of appropriate threshold values from running the diagnostic test sequence. In the latter instance, a CD, flash memory, hard drive or other recorded medium could include an embedded diagnostic sequence that tests system hardware and speakers to identify specific threshold values needed. Other methods for defining and/or preassigning threshold values will be apparent to those skilled in the art, based on the exemplary foregoing description, will be apparent.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in configuration, implementation, form, function and manner of operation, assembly and use may be made, without departing from the principles and concepts of the invention as set forth in the claims.

I claim:

1. A signal processing system for use with an audio system, including a plurality of audio channels, each channel associated with at least one amplifier and at least one electro-acoustic transducer, said electro-acoustic transducer of each channel being positionable relative to at least one other such transducer of the plurality of audio channels so as to enable perception, on the part of a listener positioned relative to said transducers, of a sonic presentation creatable by audio signals carried by said plurality of channels and reproducible using said transducers, the sonic presentation having tonal aspects, including frequency and overload-amplitude-induced frequency distortion aspects, and spatial aspects, including some image and directional-cue aspects, and the audio system having a power capability of each channel without introduction of audible tonal distortion due to overload and a total power capability of the system including the power capability of all the channels combined without introduction of audible tonal distortion due to overload;

at least one signal level threshold associated with at least one of said plurality of audio channels;

a signal processor enabling manipulating the audio signals in the channels for dynamic power sharing in the audio system, responsive to said at least one threshold, such that upon a signal in at least one channel reaching said at least one threshold associated therewith, at least a portion of the audio signal in said at least one channel is routed to and mixed with an audio signal in at least one other channel, so that the signal level in the said at least one channel does not go so high as to give rise to an increase in audible tonal distortion due to overload, said routing taking into account the relative positions of the transducers associated with said channels in light of said perception on the part of said listener;

the processor being so configured that in such manipulation the preservation of the fidelity of reproduction of said sonic presentation is a priority.

2. A signal processing system as set forth in claim 1, wherein the system is configured so that the signal level is limited in a channel having a threshold so that the signal level in that channel does not go so high as to cause a condition wherein said power capability of said channel is exceeded so as to cause an increase in audible distortion, and wherein in such manipulation the priority of preserving the fidelity of reproduction of the sonic presentations is:

first, to the tonal distortion aspects; and, second, to the spatial distortion aspects, including at least one of a) sonic image fidelity; b) minimizing distortion of directional cues; and, c) minimizing directional vector distortion, so that preservation of the sonic presentation perceivable by a typical listener in such routing is a priority within the total power handling capability of the entire system.

3. A signal processing system as set forth in claim 1, wherein the system is configured so that when the threshold is reached in a channel having a threshold associated therewith, at least a portion of the signal is limited in said channel, and said at least a portion of the signal routed to another channel essentially corresponds to that portion of the signal that is limited in said channel having a threshold associated therewith when the threshold is reached, an increase in audible distortion in the channel having a threshold associated therewith from which the signal portion is routed being mitigated by keeping the signal level in that channel having a threshold associated therewith within said power capacity of that channel.

4. A signal processing system as set forth in claim 2, configured so that:

signals can be routed and mixed to use the power capability of at least two channels, and up to all the channels, of the audio system;

the signal level and power in one channel and up to all the channels is limited so that tonal distortion due to overload perceivable by a typical listener is reduced; and firstly, when possible both such perceivable tonal distortion and spatial distortion of the sonic presentation perceivable by a typical listener are minimized in said routing, and secondly, when minimization of both of such tonal and spatial distortion is not possible while staying within the total power capability of the system, then, while yet staying within the total power capability of the system, spatial distortion—including sonic image distortion and directional vector/cues aspect distortion—is allowed prior to allowing tonal aspect distortion of the sonic presentation;

whereby essentially the total power handling capacity of each of the channels having at least one of a) a threshold, and b) configuration to receive a routed signal portion from another channel of the audio system, can be exploited prior to allowing such tonal distortion.

5. A signal processing system as set forth in claim 4, where the signal processor is configured so that the manipulation can route a portion of the signal in a way to minimize spatial distortion by at least one of:

division of the routed signal, and sending the divided signal portions to two channels having transducers positioned relative to a transducer of the channel in which the threshold is exceeded so that perception of the sonic image is less disturbed as a result of the manipulation;

asymmetrical division of the routed signal, and sending signal portions to at least two channels having transducers positioned relative to a transducer of the channel in which the threshold is exceeded such that perception of the sonic image is less disturbed as a result of the manipulation providing for at least one of a) a phase difference, and b) a time delay, of the signal portion routed to another channel with respect to the signal left in the channel from which said portion is routed;

providing for a reduced sound pressure level of the routed signal portion of the signal reproduced with respect to that reproduced in the channel where the threshold is reached, as perceived by a listener;

directing the routed signal portion above the threshold to a more robust channel than that from which it was diverted;

routing a lower frequency portion of the signal in the channel where the threshold is reached to another channel configured for reproducing lower frequency signals better than that channel from which said signal portion was diverted.

6. A signal processing system as set forth in claim 4, wherein the system is configured to enable:

mixing of a signal portion routed from another channel, with an ability to mix a signal portion into an input of a channel which has an input signal that is already mixed;

routing, re-routing, and mixing until up to all channels are at full power handling capacity, whereby overloads in one to a multiplicity of particular channels can be spread across other channels and the total power capability of the audio system can be more fully utilized in said manipulation.

7. A signal processing system as set forth in claim 6; wherein the system is configured for routing and re-routing signal portions and allowing mixing and remixing and spreading of signal power in said manipulation as required to reproduce the signals to create the audio presentation, and: a) in a case of audio signal level going above the thresholds of a plurality of channels, allowing distortion of the spatial aspect before distortion of the tonal aspect, until each of the channels reach their respective thresholds; and, b) after thus reaching the threshold of each of the channels and thus a total power capacity of the system, allowing at least one of an increase in perceivable spatial distortion and a reduction of perceived sound volume prior to allowing an increase in other audible distortion which is tonal in nature due to overload.

8. A signal processing system as set forth in claim 4, wherein a least one of:

a) a threshold; and, b) a portion of the signal moved to another channel, is frequency dependent.

9. A signal processing system as set forth in claim 8, where the routed portion of the signal is moved to a channel which is more robust over at least a portion of a frequency range of said routed signal portion.

10. A signal processing system as set forth in claim 1, wherein the threshold is determined with reference to potential signal distortion due to at least one of:

a) physical characteristics of the transducer, further comprising at least one of excursion limits of the transducer, and potential induced stress in transducer materials;

b) amplifier characteristics, further comprising onset of signal distortion;

c) thermal characteristics of an audio system component, further comprising at least one of overheating of an amplification component, and overheating of a transducer component;

d) an output of a sensor; and, e) a combination of at least one of the foregoing (a, b, c, and d), and signal frequency.

11. A signal processing system as set forth in claim 1, wherein in said manipulation a lower frequency portion of the signal in the channel from which said portion was routed from is routed to at least one other channel comprising at least one of:

a higher power handling capacity at lower frequencies than said channel from which said portion was routed;

a center channel;

a channel having a woofer-type transducer; and, a channel having a subwoofer-type transducer.

12. A signal processing system as set forth in claim 1, wherein the signal processor is configured to use information encoded in an audio signal source program material in such manipulation.

13. A signal processing system as set forth in claim 1, wherein the signal processor is configured so as to enable providing a time delay of an audio signal.

14. A signal processing system as set forth in claim 1, wherein:

the processor is configured such that upon a signal in at least one channel reaching the said at least one threshold associated therewith, the signal in said at least one channel is limited in such a way that audible tonal distortion in said at least one channel is mitigated and at least a portion of the audio signal in said at least one channel is routed to at least one other channel so that an unused portion of the total power capability of the system can be used to help reproduce said signal in said at least one channel when the power capability of said at least one channel is not enough to reproduce said signal therein without audible tonal distortion; and mitigating distortion of the sonic presentation in said manipulation by firstly, as a higher priority minimizing distortion of the sonic presentation by minimizing tonal distortion; and secondly, preserving the spatial aspects of the sonic presentation by minimizing spatial distortion subject to said first priority of preserving the tonal aspects of the sonic presentation, whereby both tonal and spatial distortion are mitigated until the signal level goes sufficiently high that both cannot be mitigated, and in that case, spatial distortion is allowed in preference to allowing tonal distortion.

15. A signal processing system for use with an audio system, including a plurality of audio channels, each channel having at least one amplifier and at least one electro-acoustic transducer, said electro-acoustic transducer of each channel being positionable relative to at least one other such transducer of the plurality of audio channels so, as to enable perception, on the part of a listener positioned relative to said transducers, of a sonic presentation creatable by audio signals carried by said plurality of channels and reproducible in audible form by said transducers;

at least one signal level threshold associated with at least one of said plurality of audio channels;

a processor enabling manipulation of the audio signals in the channels, responsive to said at least one threshold, such that upon a signal in at least one channel reaching the said at least one threshold associated therewith, at least a portion of the audio signal in said at least one channel is routed to at least one other channel, and the signal in said at least one channel reaching the threshold is limited in conjunction with such routing so that said at least one channel does not overload and thereby introduce distortion due to overload;

wherein in such manipulation a priority of preserving the fidelity of reproduction of the sonic presentation is first to the tonal distortion aspects and second to the spatial distortion aspects, and wherein first both tonal distortion and spatial distortion are minimized in said routing, but when signal power rises above a level where both tonal distortion and spatial distortion can be minimized staying within the total power handling of the system, spatial aspect distortion due to said manipulation is allowed in preference to allowing an increase in tonal aspect distortion due to overload, so that the sonic presentation perceived by a typical listener is preserved insofar as possible in such routing for the audio system within the power capability of the audio system.

16. A signal processing system as set forth in claim 15, configured such that a channel receiving a routed portion of a signal from another channel also has a threshold, and a portion of the total signal directed to said channel receiving a routed portion can be re-routed to at least one other channel, and where signal portions are mutable and re-routable when the thresholds of at least two channels in the system are reached, whereby the total power capability of the system can be better utilized in reproduction prior to allowing an increase in tonal distortion due to overload.

17. A system as set forth in claim 16, wherein all the channels of the system have thresholds, and mixing of signals routed from other channels is accommodated in all of the channels, and thus more of the system capacity can be used if needed to reproduce a portion of a signal above a threshold in a channel, and to reproduce portions of signals above a threshold in a plurality of channels, whereby more of the total power capacity of the audio system can be used prior to allowing reduction of overall level or other perceivable tonal distortion of the sonic presentation due to overload.

18. A signal processing system as set forth in claim 16, wherein a level of an audio signal is reduced in preference to introducing tonal distortion of the signal reproduced in a channel of the audio system due to overload.

19. A signal processing system as set forth in claim 15, wherein the audio system includes:

at least three channels; and an audio signal corresponding to each channel;

and wherein the signal processor routes at least a portion of the audio signal of the channel reaching the signal threshold to at least one other channel of the audio system using at least one technique to minimize disturbance of the audio image projected by the audio system, said at least one technique being selected from the group of techniques consisting of:

a) a volume level of the portion of the audio signal being mixed with that of another channel is held low enough with respect to that of the channel in which it originated that a directional cue as to the source of the signal in a listening environment is essentially maintained;

b) at least one of a phase difference and a time delay of the portion of the audio signal being mixed with that of another channel is used, and is great enough with respect to that of the channel in which it originated that a directional cue to the source of the signal in a listening environment is essentially maintained; and c) mixing said portion of the audio signal into those of at least two other channels which have transducers connectable and positionable relative to that of the channel from which the signal originates so that from the perspective of a listener a virtual source of said audio signal portion reproduced is created in a position close enough to position of a source of the reproduced original channel audio signal from which it originates that a directional cue as to source is essentially maintained.

20. A system as set forth in claim 15, wherein the signal processing system further comprises at least one of the following:

a) a signal level threshold that is frequency dependent;

b) a re-routed signal portion that is frequency dependent;

c) a channel of the audio system being a center channel and the processor being configured for routing a signal portion from another channel to said center channel;

d) a channel of the audio system being a subwoofer channel and the processor being configured for routing a signal portion from another channel to said subwoofer channel;

e) a channel of the audio system to which a signal portion is routed being more robust than the channel from which said signal portion is routed from;

f) the signal processing being configured so that each channel has a threshold and can accept signal portions from other channels mixed in their inputs, whereby signal portions above the respective thresholds of the respective channels can be spread out across a plurality of channels of the system and remixed until the power capacity of the channels of essentially the entire system can be utilized if needed in reproducing the loud portions of the audio program material as embodied in the respective audio signals in the respective channels;

g) the signal processing being configured for a routed signal portion above a threshold to be divided and routed to a plurality of other channels in one of evenly-divided strength and unevenly divided strength as may be required in the case depending on the locations and types of transducers in said other channels in order to better mitigate distortion of the sonic presentation in such manipulation;

h) the signal processing being configured for mitigating distortion of the sonic presentation in said manipulation by at least one of:

i.) a relative phase adjustment between an original signal in a first channel and a routed signal portion mixed with another channel;

ii.) a relative time delay between an original signal in a first channel and a routed signal portion mixed with another channel;

iii.) relative level of the original signal and a re-routed portion of said original signal mixed with another channel;

iv.) routing a signal portion to at least one other channel with transducer(s) positioned relative to the transducer of the original channel and a listener so that sonic image distortion inherent in such routing and re-routing is mitigated.

21. A signal processing system as set forth in claim 15, wherein the signal processor is configured to use information encoded in an audio signal source program material in such manipulation.

22. A signal processing method for use with an audio system, comprising the steps of:

increasing the apparent audio output of the audio system having a plurality of channels, each channel having at least one amplifier and at least one electro-acoustic transducer, said electro-acoustic transducer of each channel being positionable relative to at least one other such transducer of the plurality of audio channels so as to enable perception, on the part of a listener positioned relative to said transducers, of a sonic presentation creatable by audio signals carried by said plurality of channels and reproducible in audible form by said transducers, the sonic presentation having tonal aspects, and spatial aspects including sonic image and directional aspects, the audio system having a power capability of each channel of the system, and a total power handling capability of said plurality of channels combined;

providing at least one signal level threshold associated with at least one of said plurality of audio channels;

providing a processor enabling manipulating the audio signals in the channels, responsive to said at least one threshold, manipulating audio signals in a plurality of channels such that upon a signal in at least one channel exceeding the said at least one threshold associated therewith, at least a portion of the audio signal in said at least one channel is routed to at least one other channel;

limiting the level of the signal remaining in, and reproduced in, said channel having a signal exceeding the threshold after said routing, so that tonal distortion of the signal reproduced in said channel due to overload is mitigated;

mitigating distortion of the audio presentation in said manipulation by firstly preserving the tonal aspects of the audio image by minimizing tonal distortion, and subject to said firstly preserving the tonal aspects, secondly, preserving the spatial aspects of the audio presentation, configuring the processor so that in such manipulation preservation of the fidelity of reproduction of the sonic presentation is a priority while also enabling better utilization of the power capacity of at least one of a) each channel of the plurality of channels, and b) the total power handling capability of the system.

23. A method as set forth in claim 22, further comprising the step of mitigating spatial distortion of the sonic presentation by at least one of:

a) delaying one of a routed portion of a signal and a re-routed portion of a signal with respect to a channel from which it is routed;

b) providing a relative phase difference between at least one of a routed portion of a signal and a re-routed portion of a signal with respect to a channel from which it is routed;

c) keeping a sound pressure level of the reproduced audio signal of at least one of a routed signal portion and a re-routed signal portion at a sound pressure level enough below that of the signal from which it is diverted as reproduced in the channel from which it was diverted that change in the perceived source location of the sound is reduced and is closer to that which would be perceived if it had been reproduced in the transducer associated with the one channel it originated from;

d) at least one of routing and re-routing a signal portion to at least one channel having at least one transducer adjacent a transducer of the channel from which it was diverted in such a way that distortion of the spatial image due to said one of routing and re-routing is minimized, and which enables reducing the disturbance of directional cues/vectors of perceived sound of the signal as reproduced.

24. A method as set forth in claim 23, further comprising the step of taking into account the frequency of the signal exceeding a threshold, where at least one of: a)

the threshold; and, b) the portion of a signal moved from a channel to another channel, is frequency dependent.

25. A method as set forth in claim 22, further comprising the steps of:

pre-encoding information usable in said manipulation in an audio signal source program material; and, using information encoded in audio signal source program material in such manipulation.

26. A method as set forth in claim 22, further including the steps of:

making at least one of a) the threshold, and b) the portion of the signal routed, frequency dependent;

routing the portion of the audio signal thus routed from an original channel to a channel which can more effectively reproduce the frequency range of the portion of the signal thus routed.

27. A method as set forth in claim 26, further comprising at least one of the following three steps:

i.) routing said signal portion from one channel to another channel having more power capability at a different frequency than said one channel, ii.) routing said signal portion from one channel to another channel having better lower frequency power handling capability, iii.) routing said signal portion from one channel to another channel at least one of a) a woofer-, and b) a subwoofer-type transducer.

28. A method as set forth in claim 26, further including at least one of the following steps:

adjusting the phase of a routed signal portion with respect to that of a channel from which it is diverted so as to mitigate distortion of the listener-perceived spatial aspect of the some presentation;

providing a time delay of a routed signal portion so as to mitigate distortion of the listener-perceived spatial aspect of the sonic presentation;

adjusting the level of the routed signal portion with respect to that of the channel from which it is diverted so as to mitigate distortion of the listener-perceived sonic presentation;

directing the routed portion of the signal to a plurality of other channels with transducers positioned relative to a transducer of the original channel and to a listener so as to enable the sonic image distortion perceivable by atypical listener to be reduced;

directing the routed portion of the signal to a plurality of other channels asymmetrically, with a larger ratio portion of the signal portion to one associated channel than to another associated channel to which a portion of said signal portion is routed, said plurality of channels having transducers positioned relative to the original channel and to a listener so that the sonic image distortion perceivable by the listener is reduced; and, applying psycho-acoustic characteristics to at least one audio signal portion in said manipulation so that distortion of the sonic presentation is reduced.

29. A signal processing system configured for dynamic power sharing in a sound reproduction system, including:

at least a first channel, a second channel and a third channel, each channel connectable to an audio transducer and each said transducer being positionable with respect to the other transducers and a listener in a predetermined way, the system being configured to enable creation of a sonic presentation including a) tonal aspects, and b) spatial aspects further including sound image and directional cue aspects, the third channel being a more robust channel over at least a portion of the frequency range of the audio signal in said third channel;

signal processing, comprising at least one of circuitry and a microprocessor, the signal processing further including a signal path for the first channel and a threshold level associated therewith, a signal path for the second channel and a threshold level associated therewith, and a signal path for the third channel;

said processing being configured to sense when an audio signal in one of the first and second channels exceeds a threshold level, and is configured to enable routing of at least a portion of said signal in excess of the threshold from at least said one of the said first and second channels of the system to the more robust third channel, at least one of tonal distortion and spatial distortion in the sonic presentation being reduced by said routing, with priority first to tonal distortion and second to spatial distortion, said routing taking into account the relative positions of the transducers associated with said channels in light of perception of said sonic presentation on the part of said listener, so as to reduce spatial distortion induced by said routing and minimize tonal distortion overall.

30. A signal processing system as set forth in claim 29, wherein the system is configured to enable at least one of the following:

a) at least one psycho-acoustic characteristic is applied to at least one channel of the system, so as to minimize spatial distortion;

b) the said least one psycho-acoustic characteristic includes at least one of i) altering phase, and ii.) a time delay;

c) the first channel being a low-frequency channel, enabling a transducer associated therewith to comprise at least one of a woofer- and a subwoofer-type transducer, d) the first channel being one of i) a center channel, and ii) a subwoofer channel;

e) at least one of: i) the threshold, and ii) the routed portion of the signal, is frequency dependant.

31. A signal processing system for use in a multi-channel audio system, including: a plurality of power amplifier channels connectable to a plurality of loudspeakers and power amplifiers, configured to receive and reproduce channel audio signals through the loudspeakers, and at least a first channel of the plurality of power amplifier channels amplifying a first audio signal, said loudspeakers being positionable with respect to each other and to a listener so as to enable creation of a sonic presentation having a tonal aspect and a spatial aspect;

a processor configured for dynamic power sharing among said channels, responsive to a signal level threshold applicable to at least said first channel, such that at and above the signal level threshold, the first audio signal in the first channel is amplitude limited and at least a portion of at least the first audio signal is mixed into at least a second channel audio signal, the amplitude limiting and signal mixing being configured so as to reduce introduction of at least one of:

a) audible tonal distortion; and, b) perceivable spatial distortion, of a sonic presentation due to said limiting and signal mixing, and with priority first to tonal distortion and second to spatial distortion, said mixing taking into account the relative positions of said loudspeakers associated with said channels in light of perception of said sonic presentation on the part of said listener to reduce perceivable spatial distortion associated with said mixing, and minimize tonal distortion overall.

32. A method for increasing the perceived output of an audio system having a plurality of audio channels, including the steps of:

providing a signal processor enabling manipulation of audio signals in said audio channels, each channel having at least one amplifier and at least one electro-acoustic transducer, said electro-acoustic transducer of each channel being positionable relative to at least one other such transducer of another channel of the plurality of audio channels so as to enable perception, on the part of a listener positioned relative to said transducers, of a sonic presentation creatable by audio signals which are carried by said plurality of channels and reproducible using said transducers, the sonic presentation having tonal distortion aspects, and spatial distortion aspects, including sonic image and directional aspects, the audio system having a power capability of each channel without introduction of audible distortion arising due to overload, and a total power capability of all the channels combined;

setting at least one signal level threshold associated with at least one of said plurality of audio channels, the signal level threshold being just below that which would give rise to introduction of audible tonal distortion of an audio signal in said at least one channel due to overload;

manipulating the audio signals in the channels, responsive to said at least one threshold, such that upon a signal in at least one channel reaching the said at least one threshold associated therewith, at least a portion of the audio signal in said at least one channel can be routed to at least one other channel, this step further comprising:

limiting the signal in said at least one channel reaching the said at least one threshold associated therewith in such a way that audible tonal distortion due to overload in said at least one channel is mitigated;

routing at least a portion of the audio signal in said at least one channel as needed to at least one other channel so that an unused portion of the total power capability of the system can be used to help reproduce said signal in said at least one channel when the power capability of said at least one channel is not enough to reproduce said signal therein without introduction of audible tonal distortion due to overload.

33. A method for increasing the perceived output of an audio system having a plurality of audio channels, including the steps of:

providing a signal processor enabling manipulation of audio signals in said audio channels, each channel having at least one amplifier and at least one electro-acoustic transducer, said electro-acoustic transducer of each channel being positionable relative to at least one other such transducer of another channel of the plurality of audio channels so as to enable perception, on the part of a listener positioned relative to said transducers, of a sonic presentation creatable by audio signals which are carried by said plurality of channels and reproducible using said transducers, the sonic presentation having a) tonal aspects, including frequency and overload-amplitude-induced frequency distortion aspects, and b) spatial aspects, including sonic image and directional-cue aspects, the audio system having a power capability of each channel without introduction of audible distortion due to overload and a total power capability of all the channels combined;

setting at least one signal level threshold associated with at least one of said plurality of audio channels;

enabling manipulating the audio signals in the channels, responsive to said at least one threshold, such that upon a signal in at least one channel reaching the said at least one threshold associated therewith, at least a portion of the audio signal in said at least one channel can be routed to at least one other channel, this step further comprising:

limiting the signal in said at least one channel reaching the said at least one threshold associated therewith in such a way that audible tonal distortion due to overload in said at least one channel is mitigated;

routing at least a portion of the audio signal in said at least one channel as needed to at least one other channel so that an unused portion of the total power capability of the system can be used to help reproduce said signal in said at least one channel when the power capability of said at least one channel is not enough to reproduce said signal therein without inducing audible tonal distortion due to overload; and, configuring the processor so that in such manipulation the preservation of the fidelity of reproduction of the sonic presentation perceivable by the listener is a priority.

* * * * *